US006647554B1

(12) United States Patent
Yan

(10) Patent No.: US 6,647,554 B1
(45) Date of Patent: Nov. 18, 2003

(54) CAP HAVING VERSATILE SUNGLASS RETAINER AND SUNGLASS RETAINING METHOD

(76) Inventor: Seun Ching Yan, 17145 Margay Ave., Carson, CA (US) 90746

( * ) Notice: Subject to any disclaimer, the term of this patent is extended or adjusted under 35 U.S.C. 154(b) by 0 days.

(21) Appl. No.: 10/406,879

(22) Filed: Apr. 3, 2003

(51) Int. Cl.[7] ..... A42B 1/24
(52) U.S. Cl. ..... 2/209.13; 351/155
(58) Field of Search ..... 2/209.13, 175.1, 2/195.1; 351/158, 155

(56) References Cited

U.S. PATENT DOCUMENTS

| | | | | |
|---|---|---|---|---|
| 264,574 | A | 9/1882 | Shone | |
| 4,179,753 | A | 12/1979 | Aronberg et al. | 2/10 |
| D384,488 | S | 10/1997 | Kaufman | D2/866 |
| 5,860,167 | A | 1/1999 | Lizio | 2/209.13 |
| 5,887,287 | A | 3/1999 | Potochnik | 2/209.13 |
| 6,185,748 | B1 | 2/2001 | DeChambeau | 2/195.1 |
| 6,237,159 | B1 * | 5/2001 | Martin | 2/209.12 |
| 6,247,177 | B1 | 6/2001 | Hayes | 2/12 |
| 6,282,721 | B1 | 9/2001 | Travalgia | 2/171 |
| 6,298,495 | B1 | 10/2001 | Totani | 2/209.13 |
| 6,397,396 | B1 * | 6/2002 | Vibert | 2/209.13 |
| 6,442,764 | B1 * | 9/2002 | Badillo et al. | 2/209.13 |

FOREIGN PATENT DOCUMENTS

| | | |
|---|---|---|
| JP | 09228133 A | 2/1996 |
| WO | WO 02/46828 A2 | 6/2002 |

* cited by examiner

*Primary Examiner*—Katherine Moran
(74) *Attorney, Agent, or Firm*—Cislo & Thomas LLP

(57) ABSTRACT

A cap having a versatile sunglass retainer and retainer enable retention of glasses of all sorts having temples and end pieces that can be passed into and held between the cap-retainer enclosure. The retention patch may be generally square and flat in shape and sized appropriately for use with a cap, such as a baseball cap. The top edge of the patch may be indented to give it a convex shape at the bottom of which a fifth fastener may be set in conjunction with the other four fasteners at the corners of the patch. Five openings are then defined between the fasteners through which the end piece of the glasses may pass. Engagement of the end pieces and temples of the glasses by the cap-patch enclosure serves to retain the glasses on the head of the wearer when the cap is worn. The retention patches are generally used in pairs so that both end pieces and temples of a pair of glasses may be engaged and better retained on the head of the wearer. Frictional engagement of the glasses via its frame and the engagement with the cap-patch enclosure serves to retain the glasses on the head of the wearer while the configuration and location of the patch and its fasteners serve to provide versatile means for glasses retention that enable many different configurations of glasses retention to be achieved.

22 Claims, 2 Drawing Sheets

FIG. 1B
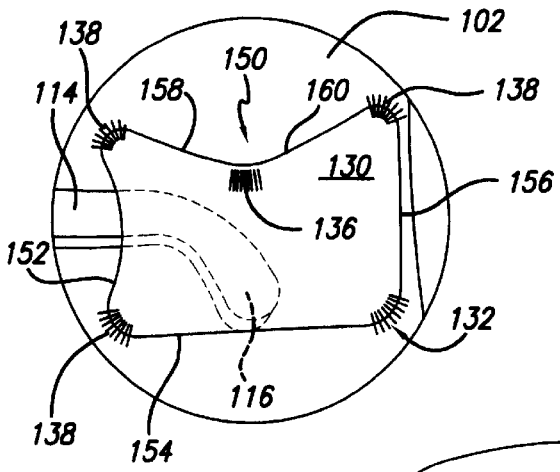
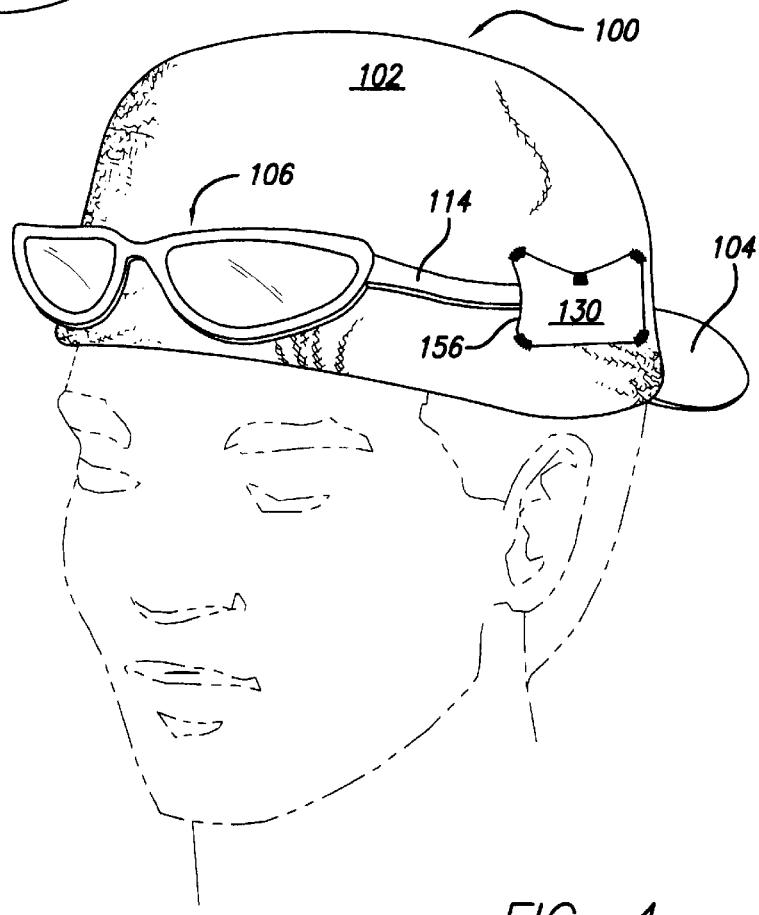
FIG. 4

CAP HAVING VERSATILE SUNGLASS RETAINER AND SUNGLASS RETAINING METHOD

BACKGROUND OF THE INVENTION

1. Field of the Invention

This invention relates to eyeglass or sunglass holders and more particularly to a sunglass retaining cap having oppositely opposed patches into which spectacle end pieces may be inserted in order for the cap to retain the glasses.

2. Description of the Related Art

Caps, such as baseball caps, are well known in the art and are often used for recreational purposes. The bowl, crown, or body of the cap provides means by which the head may be covered in order to keep it protected from the sun and the attached bill, brim, or visor stands generally horizontally from the crown in order to provide a shade for the eyes. The baseball cap as a whole is generally made of cloth with optional stiffening material such as cardboard or plastic used for the bill. The cap may be made in a number of sections and may have a stretchable headband in order to provide elastic engagement for the head of the wearer.

In order to further protect the eyes, many people wear sunglasses in conjunction with the baseball cap. Sunglasses generally provide protection from UV (ultraviolet) light that has a tendency to damage the eyes by radiation as absorption of such UV light by the retina, cornea, and other structures of the eye tend to damage them. Much like damage to the skin severed from exposure to ultraviolet light, the eye can also suffer damage from the absorption of such energetic light. Some sunglasses may also be polarized in order to transmit to the wearer's eye only light of certain polarization. Particularly, glare which arises from reflected sunlight can be reduced by polarized sunglasses.

Such sunglasses may be prescription or nonprescription sunglasses as such sunglasses are generally constructed in the same manner. Eyeglasses usually have a lens holding portion and a bridge that spans the nose between the two eyes. Temples are generally hingedly attached to the lens holding structure and extend backwardly away from the face to curve about the ear by means of an end piece. The glasses are then retained upon the face generally by frictional engagement at the bridge of the nose and the back of the ears. One specific advantage to wearing glasses is that they can be removed so the user or wearer can look out with his or her eye upon what is to be seen unaltered by the lenses of the glasses.

It has occurred to some, as evidenced by the prior art, that hats or caps may be used to retain glasses, including sunglasses. Several attempts have been made in the art previously, however they do not provide a number of advantages and generally have one or more drawbacks which may be addressed by an advance in the art:

U.S. Pat. Nos. 6,298,495, 6,282,721, 6,247,177, 6,237,159, 6,185,748, 5,887,287, 5,860,167, D.384,488, 4,179,753, 264,574, WO 02/46828, JP 09,228,133.

Some of the more pertinent prior glasses-retaining hats of the references above are described in additional detail below.

U.S. Pat. No. 6,237,159 discloses a hat having a sleeve attached to each side of the hat for retaining the earpieces of an eyeglass. FIG. 2 and column 2, line 60 et seq. are seen as pertinent, but describe a limited solution to the glass-retaining goal.

U.S. Pat. No. 4,179,753 discloses an eyeglass supporting hat having a forward opening pocket sewn to each side of the hat and adapted to receive the ends of a temple of the eyeglasses. Furthermore, temple-retaining loops which are stitched to the sides of the hat are also disclosed. FIG. 1 (elements 16, 18 and 20) and FIG. 4 (elements 56, 60, 62 and 64) show pictorially some of these elements.

U.S. Pat. No. 6,298,495 discloses a hat having a hole on either side of the hat so as to retain the temples of an eyeglass as indicated at column 1, line 63 et seq.

U.S. Pat. No. 5,860,167 discloses headwear having a loop on both sides of the headwear for retaining a temple portion of an eyeglass. FIG. 1 (element 122), and column 4, lines 26–32 elaborate on this concept.

The following patents pertain to headwear having means for holding eyeglasses when not in use: U.S. Pat. Nos. 6,247,177; 6,282,721; 5,887,287; 6,185,748; and 264,574.

U.S. Pat. No. Des. 384,488 shows a design patent for a cigar-retaining hat having a similar concept to a glasses-retaining cap. Additionally, some foreign patent application activity is known as reflected by Patent Cooperation Treaty (PCT) International Application Publication No. WO 02/46828 which discloses a hat-mounted eyeglass holder as indicated in FIGS. 1 and 6. Also, Japanese Patent Publication No. 09228133A discloses a hat having holes for the attachment of eyeglasses.

Despite the fact that eyeglass- or sunglass-retaining members are known in the art, none of them provide versatile means by which such glasses (or other objects) may be held in a variety of dispositions and manners according to the convenience of the wearer. In fact, generally all of the glasses-retaining members are configured only to hold the glasses in one configuration only. Consequently, it would be an advance in the art to provide an eyeglass-retaining member that holds eyeglasses in a number of convenient positions so that the wearer may have a number of choices by which he or she may conveniently dispose the eyeglasses off the face and onto the accompanying hat or cap.

SUMMARY OF THE INVENTION

In view of the foregoing disadvantages inherent in the known types of glasses-retaining caps and hats as well as associated members thereof now present in the prior art, the present invention provides a new cap having a versatile sunglass retainer as well as a new retaining member wherein the same can be used for retaining sunglasses when such glasses are taken off the face.

The general purpose of the present invention, which will be described subsequently in greater detail, is to provide a means by which sunglasses may be retained in conjunction with the hat or other headgear which has many advantages of the glasses-retaining members mentioned heretofore and many novel features that result in a new cap with a multi-faceted and versatile sunglass retainer which is not anticipated, rendered obvious, suggested, taught, or even implied by any other prior art glasses-retaining members, either alone or in any combination thereof.

A cap, such a baseball cap, has oppositely opposed patches generally located on the part of the cap residing above the ears of the wearer or otherwise according to the dictates of the glasses involved. Such patches are generally fastened, fixed, or attached to the cap in five places: the four corners of the patch (which is generally rectangular in shape) as well as the center of the top edge of the patch which may be slightly indented towards the interior of the rectangular patch.

This configuration of the patch provides a number of slots formed between the retaining members in the form of the fastenings attaching the patch to the hat so that the glasses (including eyeglasses and sunglasses) may be retained by the resulting cap-patch enclosure by engagement of the end piece of the temple. The specific configuration of the patch fastenings enable the eyeglass-retaining patch to hold the glasses either right side up, upside down, or positioned on the forehead, on the brow, over the head, and otherwise in a variety of convenient and useful positions by which the glasses may be readily retained by the cap yet kept safely out of the way and off the wearer's face.

OBJECTS OF THE INVENTION

It is an object of the present invention to provide a cap that versatilely retains sunglasses and the like.

It is another object of the present invention to provide a means by which headgear including caps and hats may retain sunglasses.

It is yet another object of the present invention to provide retrofitable means by which caps may be able to retain sunglasses in a versatile manner.

It is yet another object of the present invention to provide a glasses-retaining member that may be attached to a variety of different headgear.

It is yet another object of the present invention to provide a cap that retains sunglasses in a variety of different manners according to the convenience and preference of the wearer.

These and other objects and advantages of the present invention will be apparent from a review of the following specification and accompanying drawings. The foregoing objects are some of but a few of the goals attained by the present invention.

BRIEF DESCRIPTION OF THE DRAWINGS

FIG. 1B is an enlarged view of the five-fastener patch indicated by circle 1B of FIG. 1A. The end piece is shown in phantom as being behind the patch.

FIG. 4 is a right rear and perspective view of the cap with its right side patch, the glasses shown in a left front perspective view thereof as the cap is reversedly fit upon the head of a wearer, the wearer shown in phantom.

DESCRIPTION OF THE PREFERRED EMBODIMENT(S)

Figure 1A:
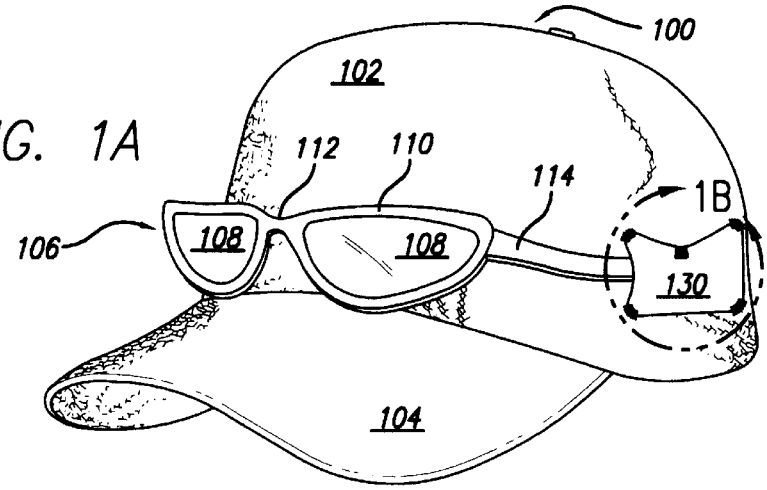
FIG. 1A is a left side perspective view of the cap having versatile sunglass retainer showing the cap, the five-fastener patch, as well as retained sunglasses, the sunglasses retained in a first position.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the drawings where like numerals of reference designate like elements throughout it will be noted that the cap 100 is generally of known construction having familiar features. The cap set forth herein may generally take the form of a baseball cap or the like, or any other cap that is capable of supporting eyeglasses, sunglasses, spectacles, and the like.

The cap 100 has a bowl, crown, or body 102 which is generally hemispherical in shape and is meant to circumscribe and cover the top of a person's head. The bill, brim, or visor 104 is common to baseball caps, "gimme" caps, and the like and generally extends horizontally out from the lower perimeter of the crown 102 and provides a shade for the wearer's eyes. In some embodiments, including that shown in the figures, the bill 104 is concavely shaped with respect to the wearer's face and head in order to provide some curvature and lateral sun screening ability for the wearer's eyes. The glasses 106 as shown in FIG. 1A generally have lenses 108 circumscribed by frame 110 which interconnects the lenses 108 via a bridge 112. Temples 114 are attached on opposite sides of the frame 110 and are generally hinged with respect to such frame 110. The temples 114 generally extend rearwardly away from the frame 110 and often end in curved end pieces 116 which curve about the wearer's ears when such glasses are worn. As used herein, the term "glasses" is meant to incorporate all such eyewear that is removably fixed to a person's face in order to provide a lens or lenses through which light is received by the wearer's eye(s). Such glasses include sunglasses, reading glasses, spectacles, bifocals, and all other glasses having temples and end pieces that may be used to help temporarily fix glasses that have been removed from the wearer's face to the cap 100.

FIG. 1A shows one configuration where the glasses 106 engage the cap 100 via a glasses-retaining patch 130. As shown in FIG. 1A, the left end piece 116 of the glasses 106 passes between the patch 130 and the crown 102 of the cap 100. The patch 130 is fixed, fastened, or attached to the crown 102 by means of one of more fasteners 132. In the figures, five fasteners are used in an asymmetrical configuration that are contemplated as providing versatile retaining means by which glasses 106 may be retained by the patch-hat enclosure.

Turning now to FIG. 1B, an enlarged and close-up view of the patch 130 is shown. The end piece 116 is shown in phantom behind the patch 130 but in front of the crown 102 of the cap 100.

The patch 130 is shown as having five fasteners 132 at generally the corners of the square defined by the patch 130. The fifth fastener 132 is generally midway between the two top fasteners and as the top edge 134 is convex, the fifth fastener 136 generally forms a downwardly pointing triangle with the two top corner fasteners 138 to provide some directional support to the end piece 116 and/or temple 114 when it passes through one or more openings 140 defined between the fasteners 132. As shown in FIG. 1B, the five fasteners 132 include the four corner fasteners 138 as well as the fifth top central fastener 136. The fasteners 132 define five openings 140 into which the end piece 116 and part of the temple 114 may fit and be held, as by compression or friction, between the patch 130 and the crown 102 of the cap 100.

The offset nature of the fifth fastener 136 provides angled top openings 150 which provide further operability for the glasses-retaining patch 130. The offset of the fifth fastener 136 with respect to the top two comer fasteners 138 may provide easier ingress and egress for the end pieces 116 passing through the respective front and rear top openings 158, 160. Additionally, due to both the extra distance between the fifth fastener 136 and the two top comer fasteners 138, additional material may be present to add support to the retained glasses 106 and enable greater surface area to be engaged by the patch 130 so as to better hold the glasses 106 in place once so retained by the patch 130.

As shown in FIG. 1B, the end piece 116 has been slipped through the front opening 152 with the end piece 116 coming in close proximity to the bottom opening 154. The rear opening 156 enables the patch 130 to engage glasses that are held on the back of the head or otherwise. The top openings 150 include a front top opening 158 and a rear top opening 160.

The fasteners, generally indicated by reference numeral 132, may be constructed of a number of materials or devices including: stitching, pins, staples, nails, rivets, adhesive, or other fastening means or fasteners. The purpose of the fasteners 132 is to attach the glassesretaining patch 130 to the crown 102 and to provide the openings 140 and cap-patch enclosure so that the glasses 106 may be retained by engagement of the cap 100 via the patch 130.

Depending upon which opening through which the end piece 116 passes, the resulting disposition of the glasses 106 may generally be determined. The glasses may be retained in an upright, upside down, backward, or forward manner as set forth in more detail below.

Figure 2:
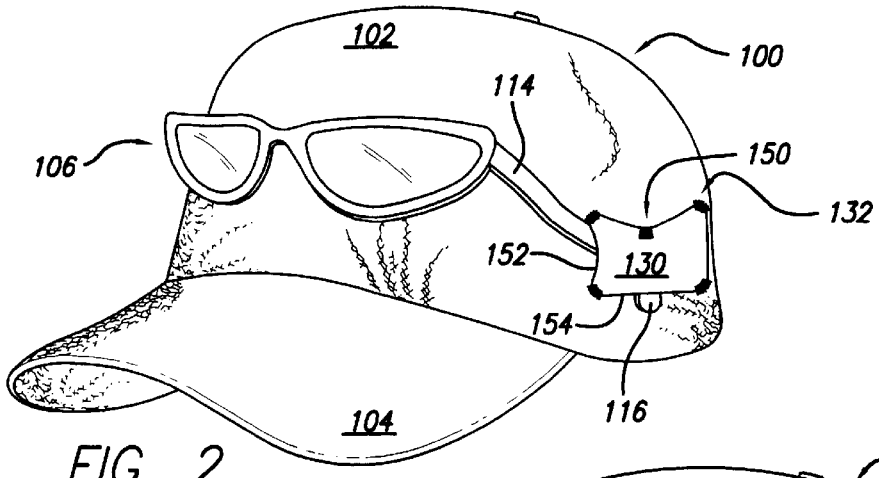
FIG. 2 is a left front perspective view of the cap, glasses, and patch of FIG. 1A showing the glasses in a second position.

In FIG. 2, the end piece 116 has been passed through the front opening 152 and subsequently seen to emerge through the bottom opening 154. This disposes the glasses 106 upwardly from the bill 104 and on the forward part of the crown 102 of the cap 100. This is in distinction to the passage of the end piece 116 through the front opening 152 as shown in FIG. 1 where the end piece 116 did not pass through the bottom opening 154 and so is generally disposed upon the bill 104.

Figure 3:
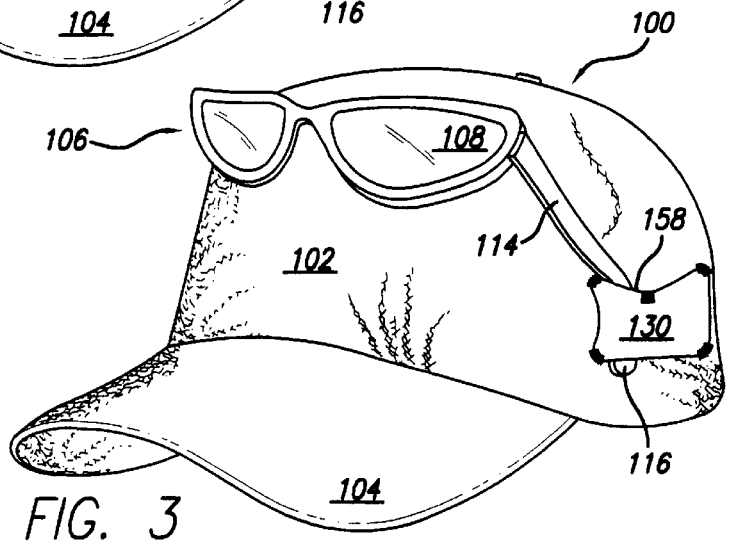
FIG. 3 is a left side front perspective view of the cap, glasses, and patch of FIG. 1A and 2 with the glasses shown in a third configuration.

FIG. 3 shows a configuration by which the glasses 106 are held even higher upon the crown 102 of the cap 100. The end piece 116 has been passed through the front top opening 158 and allowed to emerge from the bottom opening 154. This lifts the glasses 106 even higher on the crown 102 above that seen in the configuration shown in FIG. 2.

Likewise, the end piece can be disposed through the rear top opening 160 to provide an even higher resulting disposition for the glasses 106.

Alternatively, the glasses may be turned upside down with respect to the right side up configuration shown in FIGS. 1A–4. This would enable the end piece 116 to possibly pass through the bottom opening 154 to allow the top of the frame 110 to rest on the bill 104 with the end piece passing upwardly into the cap-patch enclosure via the bottom opening 154. Similarly, glasses 106 disposed in the upside down configuration can have the end pieces pass through the other openings, including the front opening 152, front top opening 158, and the rear top opening 160. Due to the curvature present in the end piece 116 with respect to the temple 114, there may be some additional elevation or lifting of the glasses 106 with respect to the bill, or brim, 104.

This provides a number of configurations any one of which may be convenient for certain purposes according to the wearer's preferences and makes the patch 130 with its fasteners 132 able to provide great versatility in enabling retention of the glasses 106.

FIG. 4 shows an alternative configuration where the cap 100 is worn backwards with the bill 104 projecting rearwardly from the rear of the wearer's head. The glasses 106 may still be retained by the patch 130 although the bill 104 is not present to provide vertical support for the glasses 106. Friction or other retention means, including outward expansion upon the temples 114 exerted by the size of the wearer's head with the cap 100 may serve to enable the glasses 106 to be retained upon the cap 100 about the person's head.

The foregoing descriptions with respect to the configurations of the glasses 106 for forward facing caps 100 of FIGS. 1A–3 are equally applicable to the configuration shown in FIG. 4 where the hat is worn in a reverse fashion.

One particularly advantageous feature provided by the patch 130 is that it may be retrofitted to caps 100 of almost any kind or sort. Consequently, manufacturers can add the sunglass-retaining patch 130 to caps of a person's choice and may enable consumers, customers, users, and/or wearers to achieve convenient sunglass-retaining capabilities in caps manufactured prior to the discovery and invention of the patch 130 herein.

Generally, the patch 130 is used in pairs oppositely opposed on either side of the crown 102. Normal use anticipates each of the two end pieces 116 of the temples 114 passing through each patch 130 the same way. However, users may depart from such contemplated use according to their preferences and, among other things, use a single patch, relocate the patch or patches, or pass the end pieces 116 through two or more patches in different ways.

While the present invention has been described with regards to particular embodiments, it is recognized that additional variations of the present invention may be devised without departing from the inventive concept.

What is claimed is:

1. A cap having a patch fastenable thereto and defining a plurality of openings through which eyewear elements may pass to retain such eyewear in association with the cap, said patch being rectangular in configuration and being attached to said cap only at the corners thereof whereby said plurality of openings are formed.

2. A cap in accordance with claim 1 where said patch further comprising:

an edge of the rectangle being concavedly shaped.

3. A cap in accordance with claim 2, wherein:

said patch is fastened to said cap at corners of said rectangle and at said concavedly-shaped edge to define five openings between said fasteners, said five openings enabling entry into a patch-hat enclosure defined between the patch and the cap.

4. A method for retaining eyewear on a hat, the steps comprising:

providing a hat;

providing a rectangular patch;

fastening said rectangular patch to said hat only at its corners to define a patch-hat enclosure having openings thereto, said patch-hat enclosure being able to receive an endpiece of the eyewear through said openings; whereby eyewear is retainable in association with the hat in a selectable manner.

5. A method for retaining eyewear on a hat as set forth in claim 4, further comprising:

said hat being a baseball-type cap.

6. A method for retaining eyewear on a hat as set forth in claim 5, further comprising:

said patch fastened to said hat at corners of said rectangle to define a plurality of openings between said fasteners, said openings enabling entry into a patch-hat enclosure defined between the patch and the hat.

7. A method for retaining eyewear on a hat as set forth in claim 5, further comprising:

an edge of said rectangle being concavedly shaped.

8. A method for retaining eyewear on a hat as set forth in claim 7, further comprising:

said patch fastened to said hat at corners of said rectangle and at said concave edge to define five openings between said fasteners, said five openings enabling entry into a patch-hat enclosure defined between the patch and the hat.

9. A method for retaining eyewear on a hat as set forth in claim 8, further comprising:

said concave edge being upwardly disposed with respect to the hat.

10. A method for retaining eyewear on a hat as set forth in claim 9, further comprising:

said fasteners defining a front opening, a top front opening, a top rear opening, a rear opening and a bottom opening through any of which an endpiece for the eyewear is able to pass.

11. A method for retaining eyewear on a hat as set forth in claim 4, the steps further comprising:

disposing said patch in a position proximately above an ear of a wearer were said hat to be worn.

12. A method for retaining eyewear on a hat as set forth in claim 4, the step of providing a patch further comprising:

providing first and second patches oppositely opposed on opposite sides of said hat.

13. A method for retaining eyewear on a hat, the steps comprising:

providing a baseball cap type hat;

providing a patch proximating a rectangle in shape with an edge of said rectangle being concavedly shaped, said concave edge being upwardly disposed with respect to said hat;

fastening said patch to said hat at corners of said rectangle and at said concave edge to define a patch-hat enclosure between the patch and the hat, said patch-hat enclosure having five openings thereto between said fasteners, said openings enabling entry into a patch-hat enclosure, said patch-hat enclosure able to receive an endpiece of the eyewear through said openings;

said fasteners defining a front opening, a top front opening, a top rear opening, a rear opening and a bottom opening through any of which an endpiece for the eyewear is able to pass; and positioning said patch in a position proximately above an ear of a wearer were said hat to be worn by said wearer; whereby eyewear is retainable in association with the hat in a selectable manner.

14. A method for retaining eyewear on a hat as set forth in claim 13, the step of providing a patch further comprising:

providing first and second patches oppositely opposed on opposite sides of said hat.

15. A hat for selectably retaining eyewear, the hat comprising:

a crown;

a patch, said patch approximating a rectangle in shape fastened to said crown to define a patch-crown enclosure having openings thereto, said patch-crown enclosure able to selectably receive an endpiece of the eyewear through said openings; whereby eyewear is retainable in association with the hat in a selectable manner, said patch fastened to said crown at corners of said rectangle to define a plurality of openings between said fasteners, said openings enabling entry into a patch-crown enclosure defined between the patch and the crown an edge of said rectangle being concavedly shaped.

16. A hat for selectably retaining eyewear as set forth in claim 15, the hat further comprising:

said patch fastened to said crown at corners of said rectangle and at said concave edge to define five openings between said fasteners, said five openings enabling entry into a patch-crown enclosure defined between the patch and the crown.

17. A hat for selectably retaining eyewear as set forth in claim 16, the hat further comprising:

said concave edge being upwardly disposed with respect to the crown.

18. A hat for selectably retaining eyewear as set forth in claim 17, the hat further comprising:

said fasteners defining a front opening, a top front opening, a top rear opening, a rear opening and a bottom opening through any of which an endpiece for the eyewear is able to pass.

19. A baseball-type cap for selectably retaining eyewear, the hat comprising:

a crown;

a patch, said patch fastened to said crown to define a patch-crown enclosure having openings thereto, said patch-crown enclosure able to selectably receive an endpiece of the eyewear through said openings;

said patch proximating a rectangle in shape, an edge of said rectangle being concavedly shaped;

said patch fastened to said crown at corners of said rectangle and at said concave edge to define five openings between said fasteners in the form of a front opening, a top front opening, a top rear opening, a rear opening and a bottom opening through any of which an endpiece for the eyewear is able to pass, said openings enabling entry into a patch-crown enclosure defined between the patch and the crown with said concave edge being upwardly disposed with respect to the crown, said patch disposed in a position proximately above an ear of a wearer were said crown to be worn by a wearer; whereby eyewear is retainable in association with the hat in a selectable manner.

20. A baseball-type cap for selectably retaining eyewear as set forth in claim 19, the cap further comprising:

said patch being a first patch;

a second patch fastened to said crown; and said first and second patches oppositely opposed on opposite sides of said crown.

21. A patch fastenable to headgear and defining a plurality of openings through which eyewear elements may pass to retain such eyewear in association with the headgear when fastened to the headgear, said patch proximating a rectangle in shape and an edge of said patch being concavedly shaped.

22. A patch fastenable to a hat, the patch enabling retention of glasses when fastened to the hat as set forth in claim 21, the patch further comprising:

said patch fastened to said hat at corners of said rectangle and at said concavedly-shaped edge to define five openings between said fasteners, said five openings enabling entry into a patch-hat enclosure defined between the patch and the hat.

* * * * *

UNITED STATES PATENT AND TRADEMARK OFFICE

CERTIFICATE OF CORRECTION

PATENT NO. : 6,647,554 B1
DATED : November 18, 2003
INVENTOR(S) : Suen Ching Yan It is certified that error appears in the above-identified patent and that said Letters Patent is hereby corrected as shown below:

Title page,
Item [76], Inventor, replace "Seun Ching Yan" with -- Suen Ching Yan --.

Signed and Sealed this

Thirteenth Day of January, 2004

JON W. DUDAS
*Acting Director of the United States Patent and Trademark Office*